US006739100B1

(12) United States Patent
Lewandowski

(10) Patent No.: US 6,739,100 B1
(45) Date of Patent: May 25, 2004

(54) RETRACTABLE IN HOUSE OPEN STAIRWELL COVER

(76) Inventor: Mark D. Lewandowski, 5045 Bridge Ct., Machesney Park, IL (US) 61115

( * ) Notice: Subject to any disclaimer, the term of this patent is extended or adjusted under 35 U.S.C. 154(b) by 1 day.

(21) Appl. No.: 10/340,695

(22) Filed: Jan. 10, 2003

Related U.S. Application Data

(63) Continuation-in-part of application No. 09/814,669, filed on Nov. 26, 2001.

(51) Int. Cl.[7] ..... E06B 3/26
(52) U.S. Cl. ..... 52/184; 52/186; 52/64
(58) Field of Search ..... 52/184, 186, 183, 52/64, 19, 39; 182/77; 244/118.5

(56) References Cited

U.S. PATENT DOCUMENTS 1,523,191 A * 1/1925 Gilfoy ..... 49/56
2,695,689 A * 11/1954 Peterson ..... 182/93
3,100,915 A * 8/1963 Pennington et al. ..... 52/64
4,541,208 A * 9/1985 Vesperman et al. ..... 52/19
5,220,757 A * 6/1993 Hulligan ..... 52/202
5,395,075 A * 3/1995 Sprenger et al. ..... 244/118.5
5,628,151 A * 5/1997 Monat ..... 52/19
5,953,866 A * 9/1999 Poole ..... 52/169.6

* cited by examiner

*Primary Examiner*—Carl D. Friedman
*Assistant Examiner*—Basil Katcheves
(74) *Attorney, Agent, or Firm*—Keith Frantz

(57) ABSTRACT

A stairwell cover adapted to seal a stairwell opening such as between a first floor living space and a basement when the basement is not in use includes a housing mounted to a wall partition above the base of the stairs, a retractable cover rotatably mounted in the housing, and a pair of roller rails extending along the sidewalls of the stairwell and along which the cover rolls for movement between an retracted position providing open access to the basement and an extended position closing off the basement at the top of the stairwell.

16 Claims, 8 Drawing Sheets

22
34
36
38
40
42
44
46
48
50
52
58
30
17
18

RETRACTABLE IN HOUSE OPEN STAIRWELL COVER

CROSS-REFERENCES TO RELATED APPLICATIONS

This Application is a Continuation-in-part application of U.S. patent application S/N 09/814,669 filed Nov. 26, 2001.

STATEMENT REGARDING FEDERALLY SPONSORED RESEARCH OR DEVELOPMENT:

Not Applicable.

REFERENCE TO MICROFICHE APPENDIX:

Not Applicable.

BACKGROUND OF THE INVENTION

1. Field of the Invention

The present invention relates generally to a device for energy conservation in residential construction.

More particularly, the invention relates to a retractable cover adapted to close off the top of an open basement stairwell of the type often built into homes of newer construction.

2. Description of Prior Art

Older homes were typically built with an access door located at the top of the stairs leading down to the basement. This door isolates the living space on the first floor from the space of the basement that is typically used for storage and other non-daily purposes, and prevents exchange between the conditioned environment on the first floor and the unconditioned environment in the basement. Specifically, the basement access door at the top of the stairs prevents the loss of cooled air-conditioned air if present down the basement steps during the summer, and it prevents cold drafts and dampness in the basement from reaching the first floor during the winter.

In contrast, many newer homes are built with an open stairwell between the first floor and the basement, with the basement access door installed at the basement level rather than on the first floor, and a large opening at the first floor level. The inventor is not positive of the purpose for relocation of the basement access door, but he supposes it is because the basement of many newer homes are at least partially finished for use as additional living space, and such an arrangement gives the appearance of including the basement in the living space of the home.

Unfortunately, this newer construction technique presents a potential for loss of heating and cooling energy for home owners that do not utilize the basement for living space. In a home where the basement level is not used, it will not typically be air-conditioned in the summer or heated in the winter, or at least not to the temperature of the rest of the house. Consequently, where once was provided a door at the first floor level, to isolate the conditioned environment of first floor from the unconditioned basement environment, is now provided an open stairwell leading down to the basement. While the access door at the basement level does provide some buffer with the basement environment, the temperature differential can often be felt through the door and the walls surrounding the stairwell. As a result, such open stairwell construction presents substantially more surface for heat transfer from the unconditioned environment to the conditioned environment, and can result in a substantial loss of heating and cooling energy between the living space of the house and the basement. The inventor has found this condition to be particularly troublesome during the winter months when the open stairwell construction exposes dampness and cold air drafts to the first floor living space.

SUMMARY OF THE INVENTION

The general aim of the present invention is to reduce the above-described energy losses common through an open stairwell between an unconditioned environment in a basement and a conditioned environment on the first floor of a home.

Accordingly, it is an objective of the invention to provide an environmental divider adapted to isolate the conditioned and unconditioned environments of the first floor and the basement.

Another objective is to provide a divider that is easily opened and closed, for ease of access between the two floors when desired.

Still another objective of the invention is to provide a retractable divider at the top of the stairwell, to cover and seal off the stairwell, and isolate the first floor from the basement access door and basement walls surrounding the stairwell, and thus prevent exposure of the living space to dampness and cold drafts from the basement.

Other objectives of the invention include providing a divider that may be either manually or electrically opened and closed, and that may be installed in both new construction and existing homes.

These and other objectives and advantages of the invention will become more apparent from the following detailed description when taken in conjunction with the accompanying drawings.

In preferred embodiments, a stairwell cover in accordance with the invention includes a housing mounted to a wall partition above the basement landing, a retractable cover rotatably mounted in the housing, and a pair of roller rails extending along the sidewalls of the stairwell. The free end of the retractable cover rolls along the rails between a retracted, stowed position in the housing providing open access to the basement, and an extended position at the top of the steps closing and sealing off the top of the stairwell. The cover is either manually operable, or is driven such as with an electric motor in the housing that is operated by a wall-mounted switch at the top of the stairwell. The housing and components therein may be either mounted to the wall partition in an existing house, or built-in during construction of a new home.

Closing off the basement stairwell in this manner seals the unconditioned environment of unused basement space from the conditioned living space on the first floor, and prevents dampness and cold air drafts from the basement to the first floor during winter months, as well as preventing cooled air-conditioned air from dropping from the first floor to the basement during summer months. Consequently, the stairwell cover of the invention results in savings of heating and cooling costs in a home, and reduces the changes in temperature on the first floor in the vicinity of the stairwell.

Figure 1:
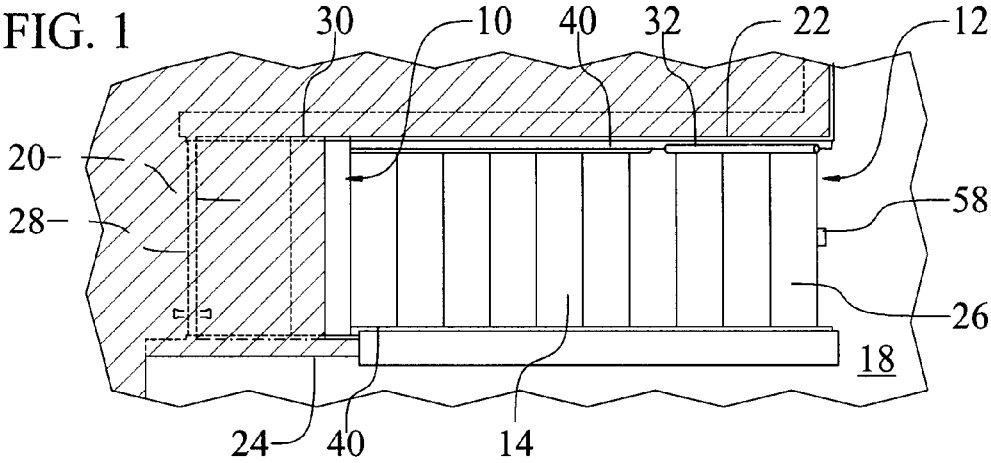
FIG. 1 is a top plan view of a conventional open construction stairwell and surrounding area in a residential home, the surrounding walls being shown in cross-section, and with the stairwell being equipped with a stairwell cover in accordance with the invention, the cover being shown in its retracted, stowed position for open access to the stairwell.
Figure 2:
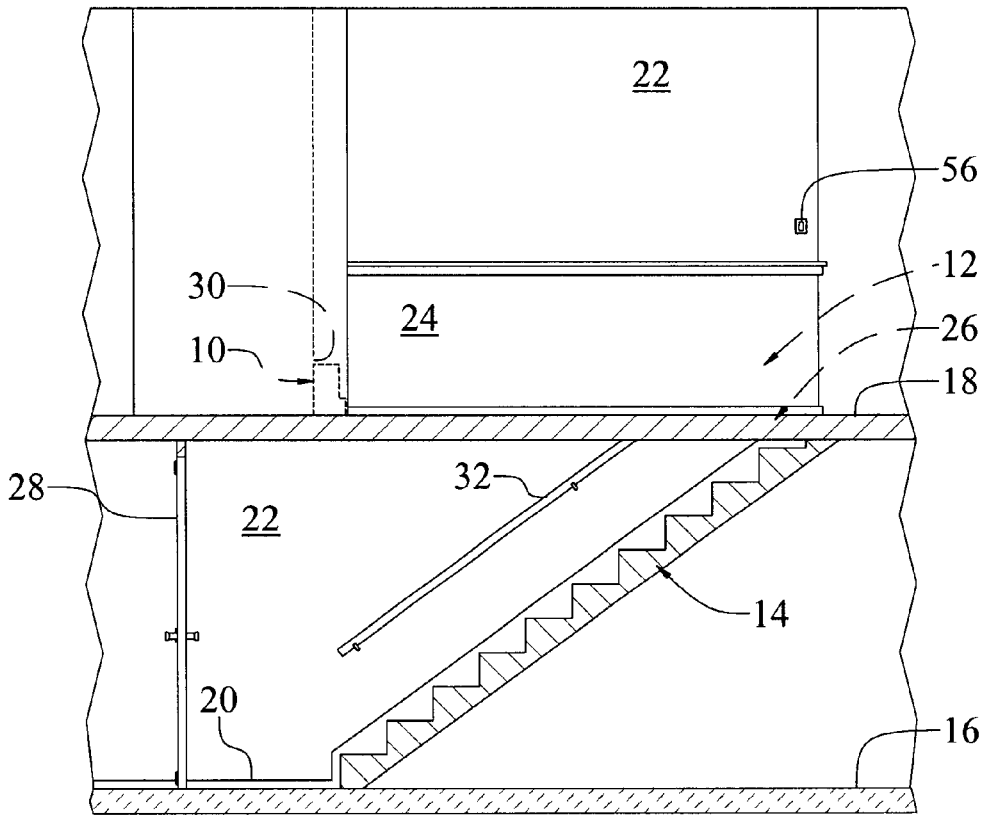
FIG. 2 is a side cross-sectional view of the stairwell and surrounding area shown in FIG. 1, with adjacent floors and stairs therebetween shown in cross-section.
Figure 3:
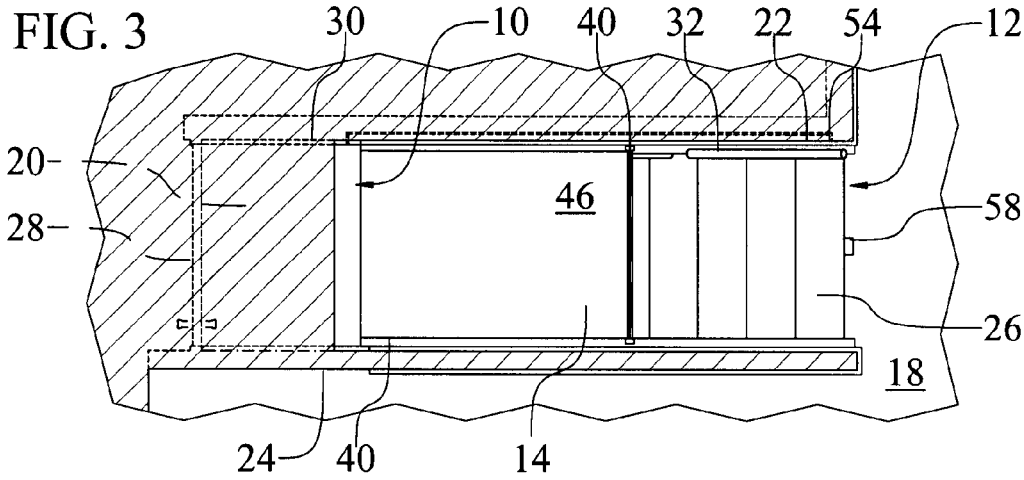
FIG. 3 is a top plan view similar FIG. 1, but showing the stairwell cover in an intermediate position.
Figure 4:
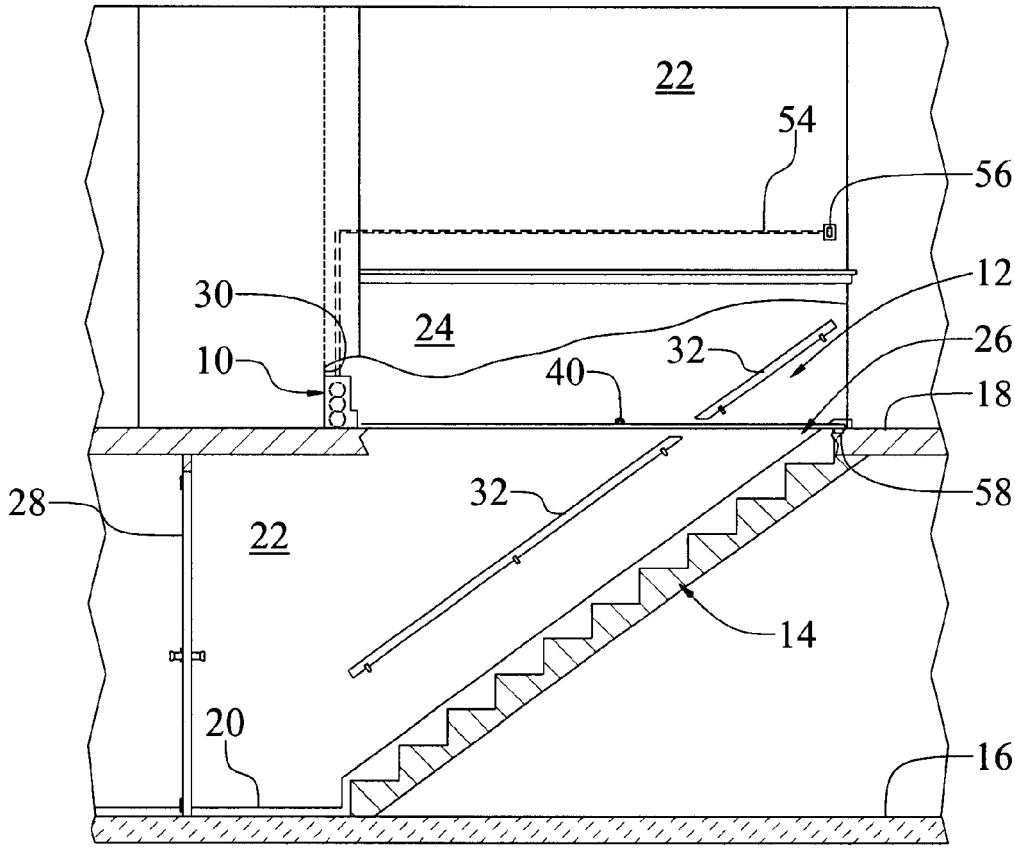
FIG. 4 is a side view similar to FIG. 2 of the stairwell cover in an intermediate position as in FIG. 3, and with the first floor and a portion of the divider wall broken away for viewing the stairwell cover and roller rails.

The following reference numerals in the drawings correspond to the following items discussed further in the detailed description below:

10 stairwell cover
12 stairwell
14 stairs
16 basement floor
18 first floor
20 basement landing
22 sidewall
24 divider wall
26 first floor access
28 basement door
30 wall partition
32 hand rail
34 housing
36 reversible electric motor
38 rollable, retractable cover
40 two roller rails
42 fasteners
44 spindle
46 elongated cover member
48 rollers
50 drive gears
52 idler gears
54 electrical wiring
56 switch control
58 magnetic latch
60 first alternate manual stairwell cover
62 first alternate rollable, retractable cover
64 first alternate housing
66 second alternate built-in stairwell cover
68 second alternate rollable, retractable cover
70 second alternate housing While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purpose of illustration, one embodiment of the present invention is shown in the drawings as stairwell cover 10 adapted to selectively open and close off an open stairwell 12 constructed with a set of stairs 14 between the basement floor level 16 and the first floor level 18 of a residential home. In a conventional manner for open stairwell construction, and as shown in FIGS. 1–4, the stairwell includes a rectangular access opening 26 cut through the first floor 18, a basement landing 20 providing access to the basement level at the bottom of the stairs, and a pair of sidewalls 22 and 24 extending through the sides of the access opening and along each side of the stairs between the basement landing and the access opening at the top of the steps. The sidewalls shown further extend upwardly from the first floor level in the form of a full-height wall 22 and a short divider wall 24. A basement access door 28 is located at the basement landing, a wall partition 30 extends upwardly from a ceiling above the basement landing on the back side of the access opening 26, and a split hand railing 32 is shown mounted to the sidewall 22 leading down the stairs.

The stairwell cover 10 (see FIGS. 5–6) includes a housing 34, a reversible electric motor 36, a rollable, retractable cover 38, and a pair of elongated roller rails 40. The housing is mounted at the back of the stairwell access opening 26, shown mounted at the first floor level to the wall partition 30 such as via mounting holes and conventional fasteners 42. The roller rails are mounted along the sides of the access opening 26, shown mounted to the sidewalls 22 and 24, along the sides of the stairwell 12, and extend therealong between the housing and the front access of the first floor access opening 26 at the top of the stairs 14. The roller rails provide secure channels for ease of operating and guidance for the cover to seal the basement stairwell opening. The cover 38 includes a spindle 44 rotatably mounted in the housing, an elongated cover member 46 connected at one end to the spindle for rotation therewith, and rollers 48 rotatably mounted to the other end of the cover member for rolling along the roller rails between a first position at the back of the stairwell opening proximate the housing to provide unobstructed access to the stairwell and a second position at the front of the access opening in the first floor access at the top of the stairwell to close-off and seal the stairwell access opening at the top of the steps. The cover member is made of lightweight rollable material, such as nylon, Kevlar or canvass, is adapted for rolling-up onto and unrolling from the spindle as it rotates, is adapted to cause the rollers to roll along the rails as the cover rolls onto and off of the spindle, and is sized to cover and close the stairwell when the rollers are positioned proximate the ends of the rails at the top of the stairs. The reversible electric motor is assembled into the housing and is coupled to the spindle for power rotating the spindle in the direction desired. In the embodiment shown, a set of drive gears 50 provided on the ends of the motor and the spindle are coupled through a set of idler gears 52. The motor is wired as at 54 to a control switch 56, such as similar to a conventional light switch, with the function of selectively opening and closing the cover. The switch is conveniently located on the wall 22 near the top of the stairwell. The free end of the cover is magnetic-field responsive for interaction with a magnetic latch 58 provided at the top of the stairs when the spindle is proximate thereto to secure the cover in its closed position.

Figure 5:
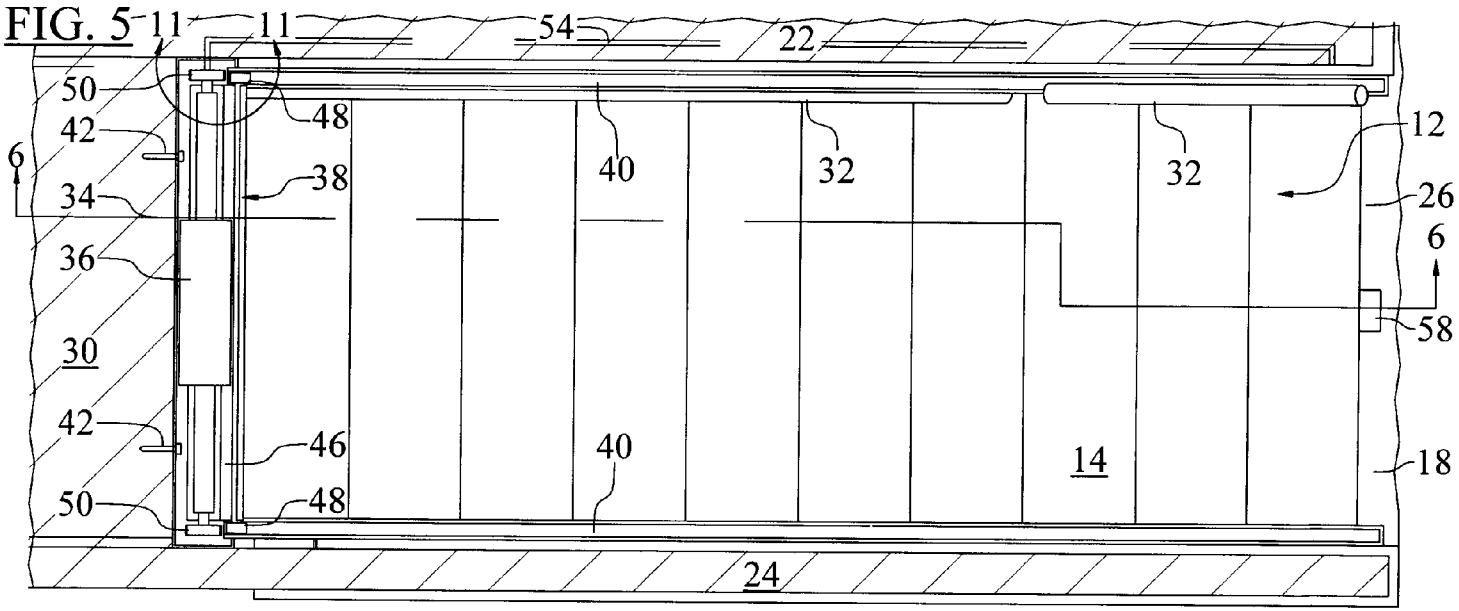
FIG. 5 is an enlarged top plan view similar to FIG. 1, but with the top of the cover housing broken away for viewing of certain internal components.
Figure 6:
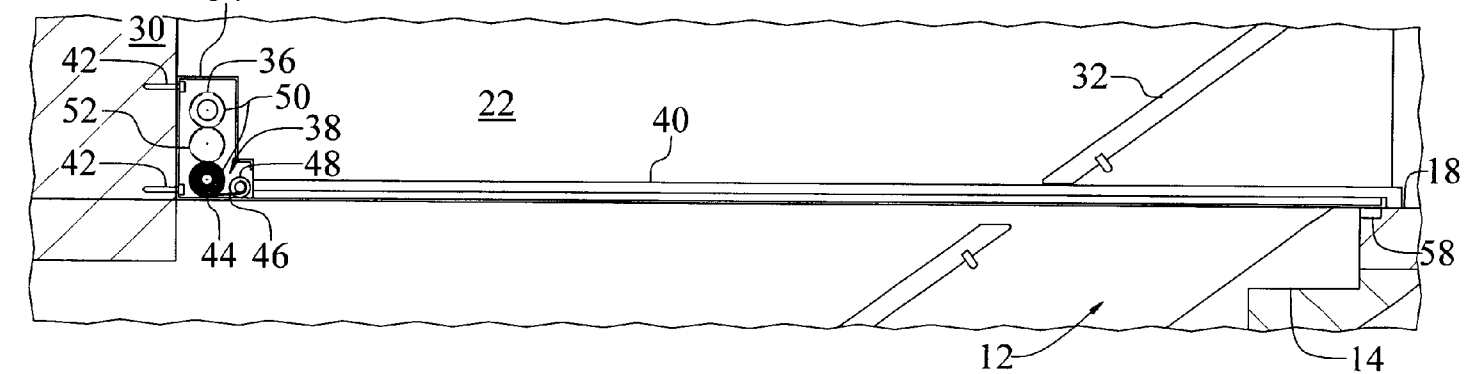
FIG. 6 is an enlarged side view taken substantially along the line. 6—6 of FIG. 5.
Figure 7:
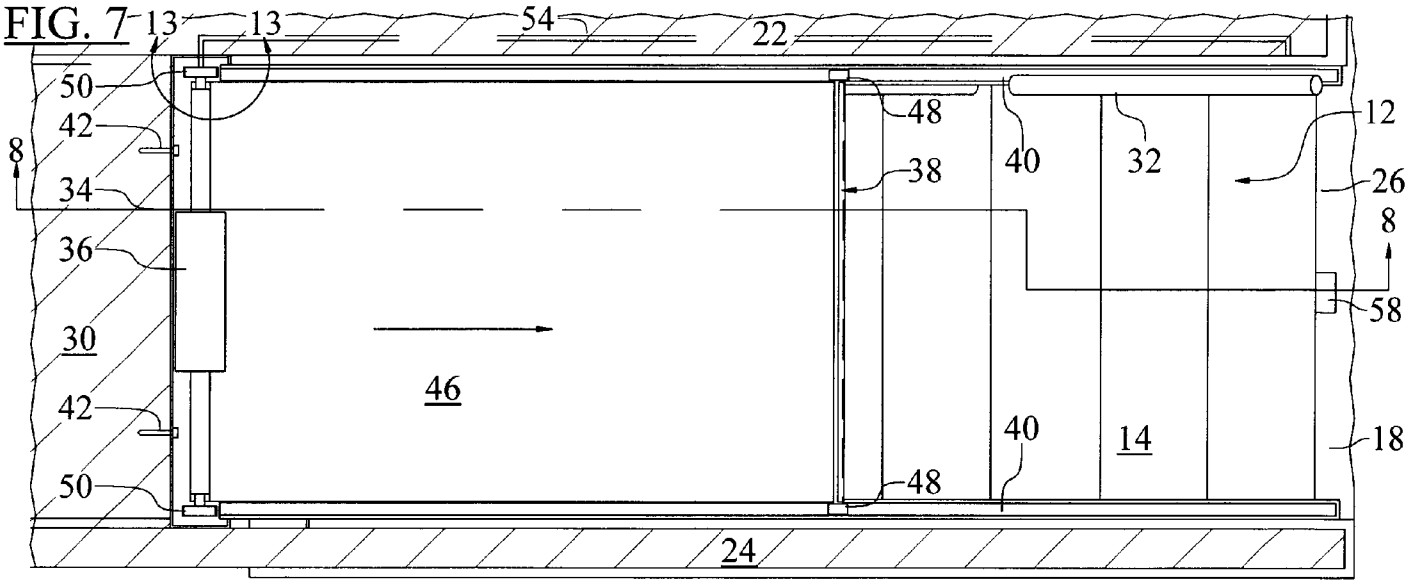
FIG. 7 is an enlarged top plan view similar to FIG. 5 but showing the stairwell cover in an intermediate position.
Figure 8:
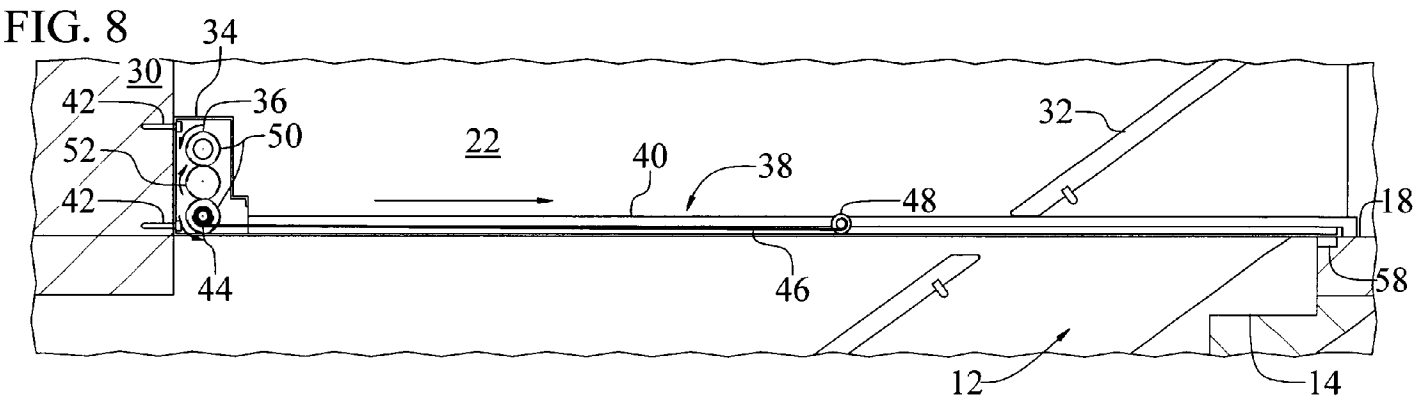
FIG. 8 is an enlarged side view taken substantially along the line 8—8 of FIG. 7.
Figure 9:
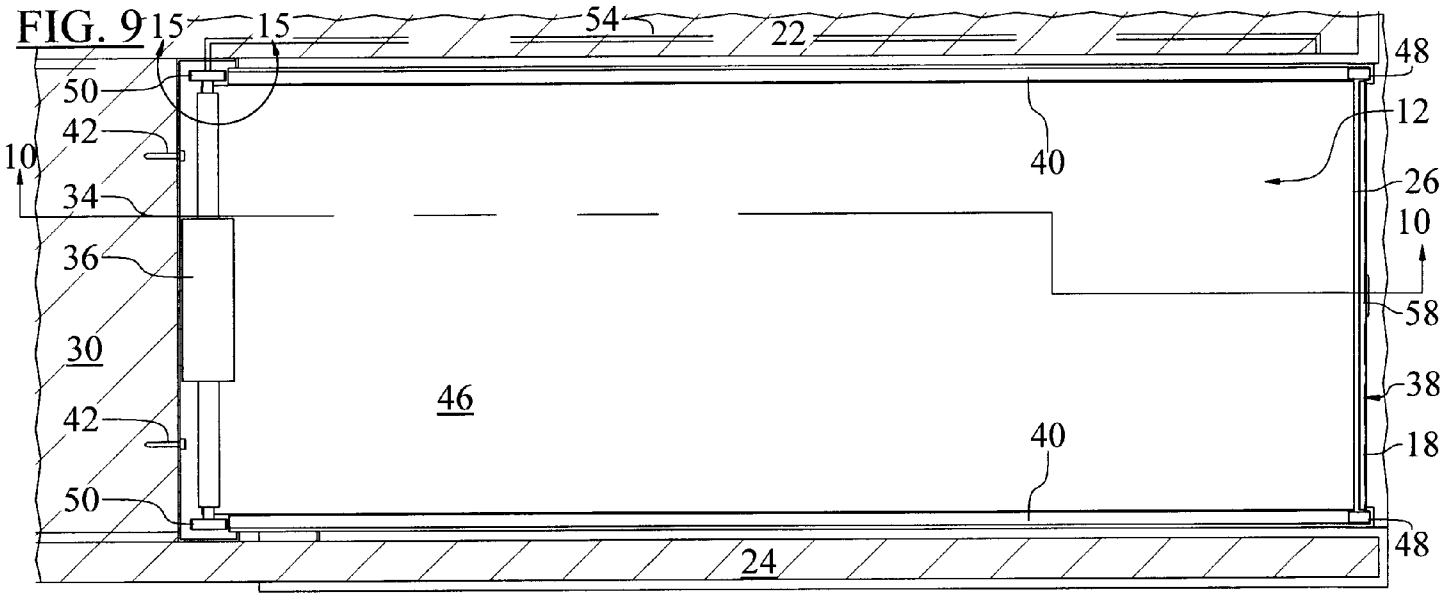
FIG. 9 is an enlarged top plan view similar to FIG. 5 but showing the stairwell cover in its extended, covering position, and with the upper portion of a hand rail not shown.
Figure 10:
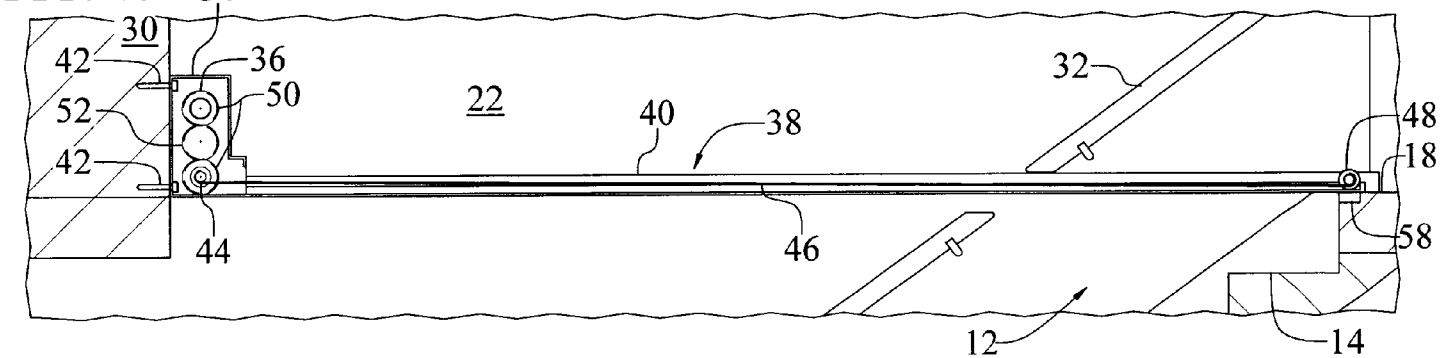
FIG. 10 is an enlarged side view taken substantially along the line, 10—10 of FIG. 9.

Operation of the stairwell cover 10 is shown sequentially in FIG. 5–10, with FIGS. 11–18 showing enlarged views of various aspects and positions of the stairwell cover. In particular, FIGS. 5 and 6 are top and side views showing the stairwell cover in its fully retracted, stowed position in the housing, with the stairwell 12 fully open for access between the first floor level 18 and the basement level 16. FIG. 7 and 8 are top and side views showing the cover in an intermediate position over the stairwell, between fully open and fully closed. Also included in FIGS. 7 and 8 are arrows indicating directions of rotation and movement for the cover as going from the open position towards the closed position. FIGS. 9 and 10 are top and side views showing the cover in its fully extended position, closing the stairwell and sealing off the basement from the first floor living space, with the magnetic latch operable to secure the cover in this closed position, and with the hand rail 32 not shown in FIG. 9 for viewing the entire cover in its extended position. Opening of the cover is, of course, the reverse process. And movement of the stairwell cover between the open and closed positions is effected by manual operation of the switch which energizes the motor in the desired direction, rotates the spindle, and causes the cover to either roll out to cover and seal the stairwell or retract to open the stairwell for access to the basement.

Figures 11, 12, 13, 14, 15, 16, 17, 18:
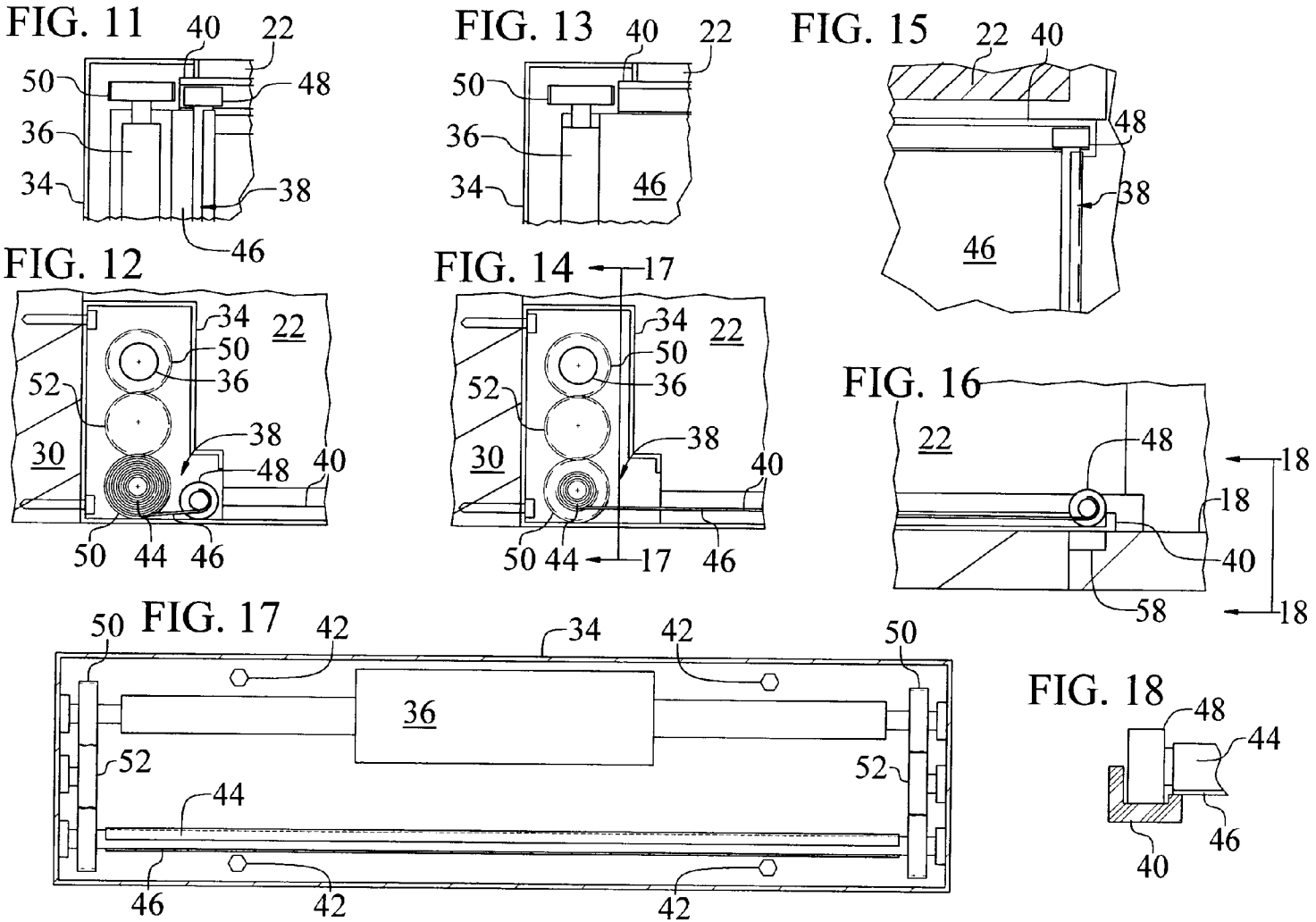
FIG. 11 is a further enlarged, fragmentary view taken in arc 11—11 of FIG. 5.
FIG. 12 is a side view of the components shown in FIG. 11.
FIG. 13 is a further enlarged, fragmentary view taken in arc 13—13 of FIG. 7.
FIG. 14 is a side view of the components shown in FIG. 12.
FIG. 15 is a further enlarged, fragmentary view taken in arc 15—15 of FIG. 9.
FIG. 16 is a side view of the components shown in FIG. 15.
FIG. 17 is an enlarged front view of the stairwell cover housing and parts therein as taken along the line 17—17 of FIG. 14.
FIG. 18 is an enlarged front view of a roller and associated track taken along the line 18—18 of FIG. 16.

For further reference, enlarged, fragmentary views of the housing and components therein for the cover in the retracted position is shown in FIGS. 11 and 12, enlarged fragmentary views of the housing and components therein corresponding to a partially open cover are shown in FIGS. 13 and 14, enlarged fragmentary views of free end of the cover in the closed position are shown in FIGS. 15, 16 and 18, and an enlarged front view of the housing, with its front cover removed, and components therein is shown in FIG. 17.

Figure 19:
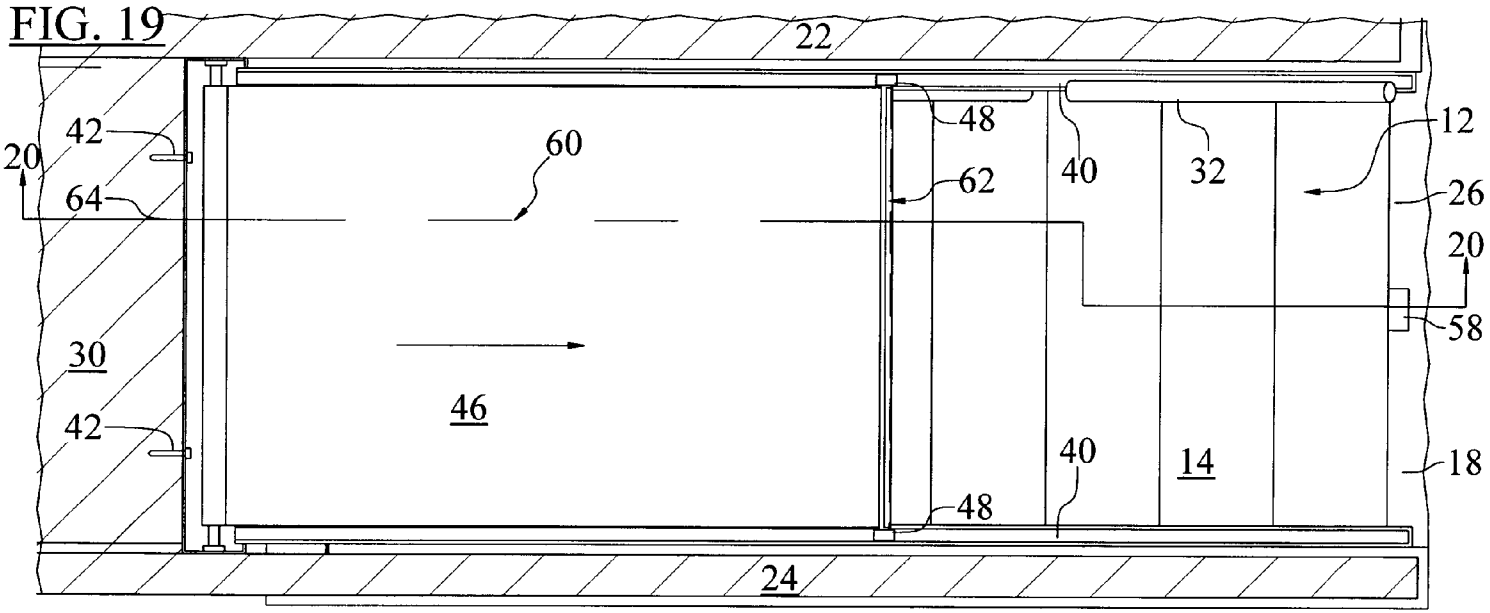
FIGS. 19 and 20 are views similar to FIGS. 7 and 8, respectively, of an alternate, manually operable, stairwell cover.
Figure 20:
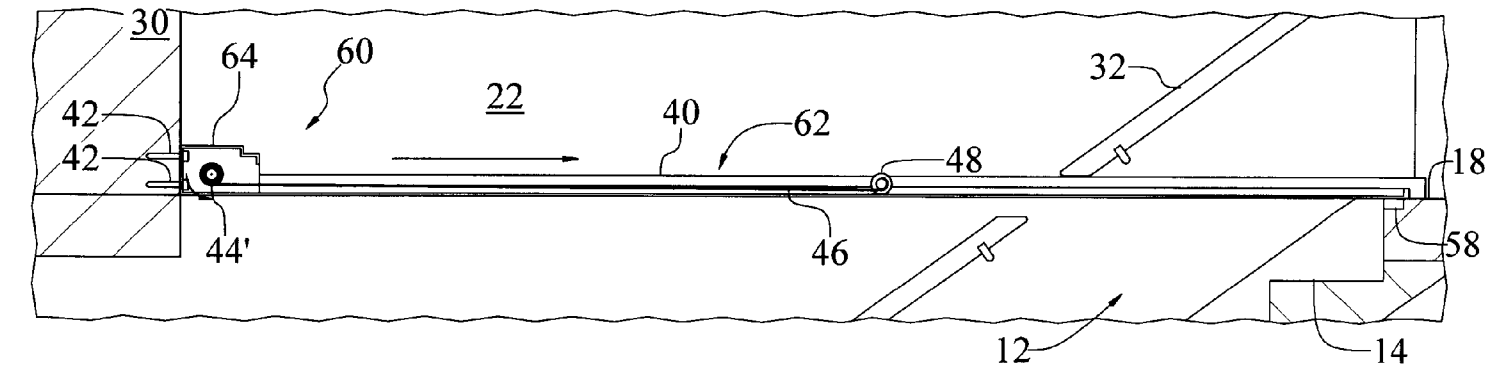
Figure 21:
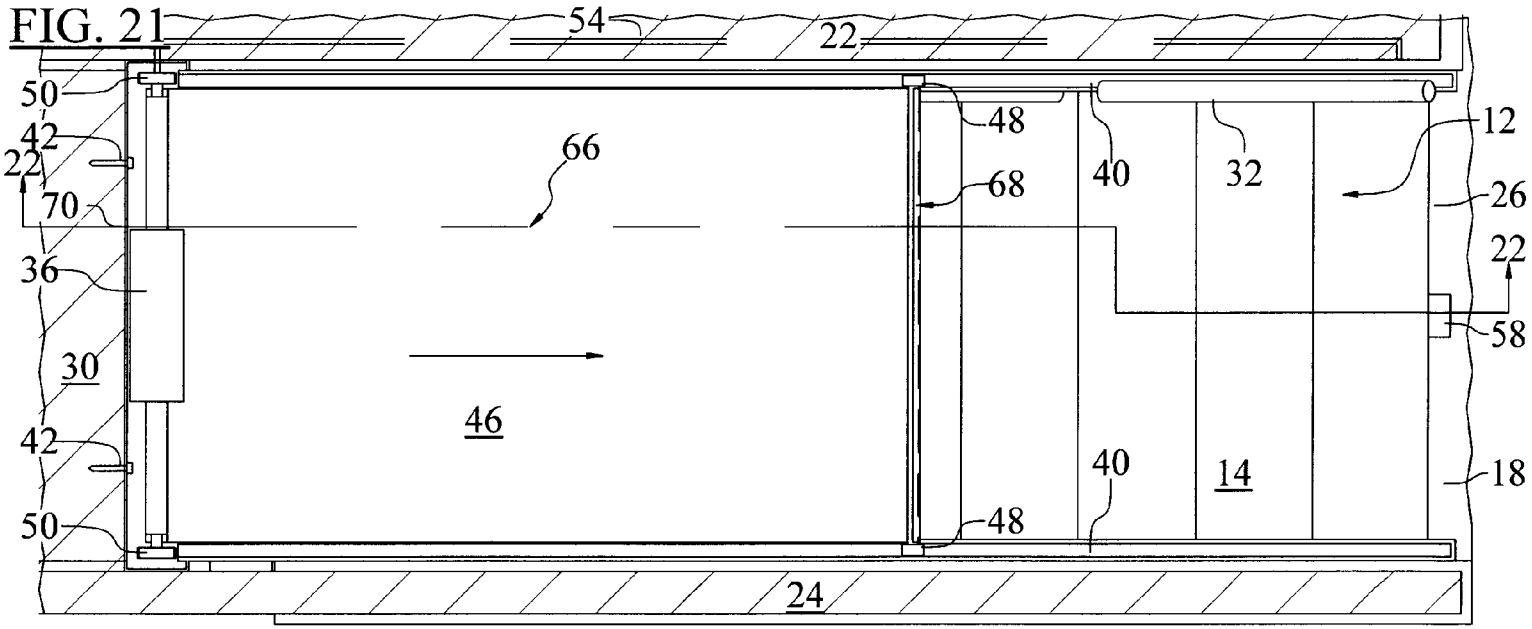
FIGS. 21 and 22 are views similar to FIGS. 7 and 8, respectively, of an alternate stairwell cover as built in during new construction.
Figure 22:
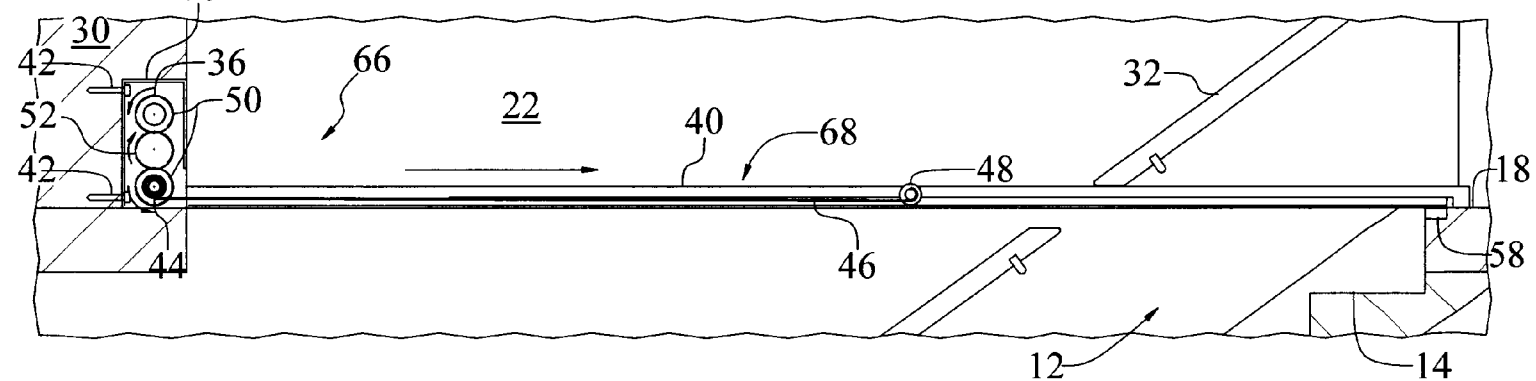

Those skilled in the art will readily appreciate that alternate embodiments may be provided within the scope of the present invention. For example, in first alternate embodiments such as shown in FIGS. 19–20, a stairwell cover 60 is provided as described above but without an electric motor and drive coupling arrangement in housing 64 such as for manual operation of the cover 62 between open and closed positions. In second alternate embodiments such as shown in FIGS. 21–22, the housing 70 and its contents of the stairwell cover 68 are built into the wall partition 30 such as particularly suitable for use in new construction. In addition, it will be appreciated that a stairwell cover in accordance with the invention is equably adaptable for use in, for example, an open stairwell between the first floor and an unused second floor.

I claim:

1. A stairwell cover for a building of the type having a first floor, a basement floor, and an open stairwell therebetween; the stairwell having a set of stairs extending between said floors, a basement landing with access to the bottom of the stairs at the basement floor level, and a rectangular access opening through the first floor for access to the top of the stairs at the first floor level; the access opening being defined between a front access at the top of the stairs, a back above the basement landing, and opposing sides on each side of the stairs between said back and said front access; the stairwell cover comprising:

(A) a housing mounted proximate the back of the access opening above the basement landing;

(B) a pair of roller rails connected along the sides between proximate the housing and the front access of said access opening; and (C) a retractable-extendable cover comprising:

(i) a spindle rotatably mounted in the housing, and (ii) a cover member connected to the spindle for rotation therewith, the cover member being (a) adapted to roll onto and off of the spindle as it rotates in the housing, and (b) sized to extend from the back of the access opening to the front access thereof to close-off the stairwell at the top of the stairs, the cover member having a front end engaging the roller rails for rolling therealong between (a) a first position proximate the housing and corresponding to the cover member in a retracted position providing open access to the stairwell, and (b) a second position in the front access corresponding to the cover member in an extended position closing off the stairwell at the top of the stairs.

2. The stairwell cover as defined in claim 1 further comprising a magnetic latch positioned proximate the front access at the top of the stairs, and the cover member being magnetically responsive to the magnetic latch for securing the cover member in its extended position closing off the stairwell.

3. The stairwell cover as defined in claim 1 in which the cover member is adapted for manual operation between said retracted and extended positions.

4. The stairwell cover as defined in claim 1 further comprising a reversible electric motor operably connected to the spindle and a control switch for electric-powered operation of the cover member between its retracted and extended positions.

5. The stairwell cover as defined in claim 1 further comprising a wall partition defining the back of the access opening and in which the housing and spindle are installed into the wall partition during construction of the building.

6. The stairwell cover as defined in claim 1 further comprising a wall partition defining the back of the access opening and in which the housing is mounted to the wall partition after completion of the building.

7. A stairwell cover for a building of the type having a first floor, a basement floor, and an open stairwell therebetween; the stairwell having a set of stairs extending between said floors, a basement landing with access to the bottom of the stairs at the basement floor level, a first floor access opening to the top of the stairs at the first floor level, a wall partition positioned above the basement landing, and a pair of sidewalls extending along each side of the stairs between said wall partition and said first floor access; the stairwell cover comprising:

(A) a housing mounted to said wall partition;

(B) a pair of roller rails connected to said sidewalls and extending therealong between proximate said housing and said first floor access; and (C) a retractable-extendable cover comprising:

(i) a spindle rotatably mounted in the housing, (ii) an elongated cover member connected to the spindle for rotation therewith, the cover member being (a) adapted to roll onto and off of the spindle as it rotates in the housing, and (b) sized to close-off the basement stairwell between the wall partition and the first floor access at the top of the stairs, and (iii) a pair of rollers connected to the cover member and positioned in the roller rails for rolling therealong between (a) a first position proximate the housing and corresponding to the cover member in a retracted position providing open access to the stairwell, and (b) a second position in the first floor access proximate the top of the stairs and corresponding to the cover member in an extended position closing off the stairwell at the top of the steps.

8. The stairwell cover as defined in claim 7 further comprising a magnetic latch positioned proximate the first floor access at the top of the stairs, and the cover member being magnetically responsive to the magnetic latch for securing the cover member in its extended position closing off the stairwell at the top of the steps.

9. The stairwell cover as defined in claim 7 in which the cover member is adapted for manual operation between said retracted and extended positions.

10. The stairwell cover as defined in claim 7 further comprising a reversible electric motor operably connected to the spindle and a control switch for electric-powered operation of the cover member between its retracted and extended positions.

11. The stairwell cover as defined in claim 7 in which the housing and spindle are installed into the wall partition during construction of the building.

12. The stairwell cover as defined in claim 7 in which the housing is mounted to the wall partition after completion of the building.

13. A stairwell cover for a building of the type having a first floor, a basement floor, and an open stairwell therebetween; the stairwell having a set of stairs extending between said floors, a basement landing with access to the bottom of the stairs at the basement floor level, a first floor access opening to the top of the stairs at the first floor level, a wall partition positioned above the basement landing, and a pair of sidewalls extending along each side of the stairs between said wall partition and said first floor access; the stairwell cover comprising:

(A) a housing mounted to said wall partition;

(B) a pair of roller rails connected to said sidewalls and extending therealong between proximate said housing and said first floor access;

(C) a retractable-extendable cover comprising:

(i) a spindle rotatably mounted in the housing, (ii) an elongated cover member connected to the spindle for rotation therewith, the cover member being (a) adapted to roll onto and off of the spindle as it rotates in the housing, and (b) sized to close the basement stairwell between the wall partition and the first floor access at the top of the stairs, (iii) a pair of rollers connected to the cover member and positioned in the roller rails for rolling therealong between (a) a first position proximate the housing and corresponding to the cover member in a retracted position providing open access to the stairwell, and (b) a second position in the first floor access proximate the top of the stairs and corresponding to the cover member in an extended position closing off the stairwell at the top of the steps, and (iv) a reversible electric motor operably connected to the spindle for electric-powered operation of the cover member between its retracted and extended positions; and (D) a control switch located in one of the sidewalls at the top of the stairwell and connected for manual switching operation of the electric motor to effect selected electric-powered operation of the cover member between said positions.

14. The stairwell cover as defined in claim 13 further comprising a magnetic latch positioned proximate the first floor access at the top of the stairs, and the cover member being magnetically responsive to the magnetic latch for securing the cover member in its extended position closing off the stairwell at the top of the steps.

15. The stairwell cover as defined in claim 13 in which the housing and spindle are installed into the wall partition during construction of the building.

16. The stairwell cover as defined in claim 13 in which the housing is mounted to the wall partition after completion of the building.

* * * * *